US007497212B2

(12) United States Patent
Choi et al.

(10) Patent No.: US 7,497,212 B2
(45) Date of Patent: Mar. 3, 2009

(54) CUTTING TOOL AND METHOD FOR MANUFACTURING THE CUTTING TOOL

(75) Inventors: Jong Suk Choi, Seoul (KR); Tae Min Um, Seo-gu (KR); In Woo Kim, Pyungtaek (KR)

(73) Assignee: EHWA Diamond Industrial Co., Ltd. (KR)

( * ) Notice: Subject to any disclaimer, the term of this patent is extended or adjusted under 35 U.S.C. 154(b) by 2 days.

(21) Appl. No.: 11/293,007

(22) Filed: Dec. 2, 2005

(65) Prior Publication Data

US 2006/0120811 A1 Jun. 8, 2006

(30) Foreign Application Priority Data

Dec. 8, 2004 (KR) ..... 10-2004-0103169

(51) Int. Cl.
*B24D 5/06* (2006.01)

(52) U.S. Cl. ..... 125/15; 451/542; 51/293

(58) Field of Classification Search ..... 451/543, 451/542, 541, 548, 449; 125/15; 51/307, 51/293

See application file for complete search history.

(56) References Cited

U.S. PATENT DOCUMENTS

| | | | | | |
|---|---|---|---|---|---|
| 3,590,535 | A * | 7/1971 | Benson et al. | ..... | 451/542 |
| 3,863,401 | A * | 2/1975 | Schwarzkopf et al. | ..... | 451/542 |
| 4,718,398 | A * | 1/1988 | Hallez | ..... | 125/15 |
| 5,791,330 | A | 8/1998 | Tselesin | | |
| 6,033,295 | A | 3/2000 | Fisher et al. | | |
| 6,273,082 | B1 * | 8/2001 | Tselesin | ..... | 125/15 |

FOREIGN PATENT DOCUMENTS

| | | | | | |
|---|---|---|---|---|---|
| DE | 7427053 | U | 12/1974 | | |
| DE | 2803850 | A1 | 8/1979 | | |
| EP | 0138237 | * | 4/1985 | ..... | 125/15 |
| JP | 0270077 | * | 11/1986 | ..... | 125/15 |
| JP | 11099478 | A | 4/1999 | | |
| JP | 2005271184 | A | 10/2005 | | |
| WO | 2005084879 | A1 | 9/2005 | | |
| WO | 2005099950 | A1 | 10/2005 | | |

* cited by examiner

*Primary Examiner*—Robert Rose
(74) *Attorney, Agent, or Firm*—Wells St. John P.S.

(57) ABSTRACT

The present invention relates to a cutting tool for cutting or drilling a brittle work piece such as stone, bricks, concrete and asphalt, and a method for manufacturing thereof. The present invention provides a cutting tool including a shank rotatably connected to a driving device and segments welded at predetermined intervals on an outer periphery of the shank. Each of the segments has abrasives attached thereto by brazing and the each segment is welded after the abrasives are brazed thereto. Also, a method for manufacturing thereof is provided. The present invention ensures improvement in cutting capacity and useful life of the cutting tool.

10 Claims, 3 Drawing Sheets

CUTTING TOOL AND METHOD FOR MANUFACTURING THE CUTTING TOOL

CLAIM OF PRIORITY

This application claims the benefit of Korean Patent Application No. 2004-103169 filed on Dec. 8, 2004, in the Korean Intellectual Property Office, the disclosure of which is incorporated herein by reference.

BACKGROUND OF THE INVENTION

1. Field of the Invention

The present invention relates to a cutting tool for cutting or drilling a brittle work piece such as stone, bricks, concrete and asphalt and a method of manufacturing thereof. More particularly, the present invention relates to a cutting tool for attaching abrasives such as diamond by brazing and a method for manufacturing thereof.

2. Description of the Related Art

To cut or drill a brittle work piece such as stone, bricks, concrete and asphalt, an abrasive with higher hardness than the work piece is required.

The abrasives include artificial diamond particles, natural diamond particles, boron nitride and cemented carbide, of which the artificial diamond particles are most widely used.

An artificial diamond (hereinafter referred to as "diamond") was invented in the 1950ies. The diamond, which is known to have the highest hardness out of materials in the earth, has been accordingly used for cutting and grinding tools due to such properties.

Especially, the diamond has been broadly used in a stone processing field where stone such as granite and marble is cut and grinded, and in a construction field where a concrete structure is cut and grinded.

An explanation will be given hereunder based on segments and the cutting tool utilizing diamond particles as an abrasive.

Typically, the method for manufacturing the cutting tool is broken down into sintering, electro-plating and brazing according to the method for attaching abrasives.

In the sintering, abrasives are mixed with metal particles acting as a bonding material, molded and then sintered, whereas in the electro-plating and brazing, abrasives are attached in a single layer.

FIG. 1 illustrates an example of a segment type diamond tool manufactured by the sintering.

As shown in FIG. 1, the segment type diamond tool 1 includes a plurality of segments 11, 12 fixed to a disc type shank (metal body) 2, each segment 11, 12 having diamond particles 5 randomly distributed thereon.

The cutting segments are fabricated by mixing the diamond particles with metal powder acting as a binder, molding and sintering the same.

In the sintering, the shank and the segments are sintered integrally or after independently fabricating segments, the segments are welded to the shank.

Meanwhile in the brazing or electro-plating, the abrasives are directly attached to the shank.

That is, in the brazing or electro-plating, a technique of independently fabricating segments with abrasives attached thereto and welding the same to the shank has not been suggested yet.

In case of attaching abrasives by the brazing, unlike the electro-plating in which the abrasives and the bonding materials bond physically, the abrasives and the bonding materials bond chemically. In addition, the bonding area by the brazing is larger than that by the electro-plating, leading to superior bonding capacity of the abrasives.

Therefore the brazing is more preferable than electro-plating in a field requiring superior bonding capacity.

However, since the abrasives should be first brazed on the shank face to be attached thereto, the brazing should be performed at a limited temperature according to materials of the shank. Subsequently, the abrasives can not attain sufficient bonding capacity. Also, the shank experiences wobbling and lower hardness by brazing, causing damage to the shank in cutting the work piece.

Furthermore, attaching abrasives on the shank surface by brazing reduces productivity.

SUMMARY OF THE INVENTION

The present invention has been made to solve the foregoing problems of the prior art and it is therefore an object of the present invention to provide a cutting tool capable of improving productivity and retention power of abrasives and preventing damage of a shank in cutting a work piece by independently fabricating segments having the abrasives attached thereto by brazing and then welding the same to the shank, and a method for manufacturing thereof.

It is another object of the invention to provide a cutting tool capable of enhancing a cutting capacity by adequately forming slots on the segments having the abrasives brazed thereto, and a method for manufacturing thereof.

It is still another object of the invention to provide a cutting tool capable of blocking transfer of friction heat to the shank in cutting the work piece, and inducing cooling of the segments by adequately forming through holes on the segments having the abrasives brazed thereto, and the method for manufacturing thereof.

Also, it is still another object of the invention to provide a cutting tool capable of improving a cutting capacity, blocking transfer of friction heat to the shank in cutting the work piece and inducing cooling of the segments by adequately forming slots and/or through holes on the segments having the abrasives brazed thereto.

The present invention will be explained in detail hereunder.

According to an aspect of the invention for realizing the object, there are provided a cutting tool comprising a shank rotatably connected to a driving device; and segments welded at predetermined intervals on the outer periphery of the shank, each of the segments having abrasives attached thereto by brazing, wherein the each segment is welded after the abrasives are brazed thereto, and a method for manufacturing thereof.

According to another aspect of the invention for realizing the object, there are provided a cutting tool including segments, each having at least one slot and/or through hole, a method for manufacturing thereof.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

Preferably, the present invention is applied to the cutting tool having abrasives brazed to a shank, and a method for manufacturing thereof.

Figure 1:
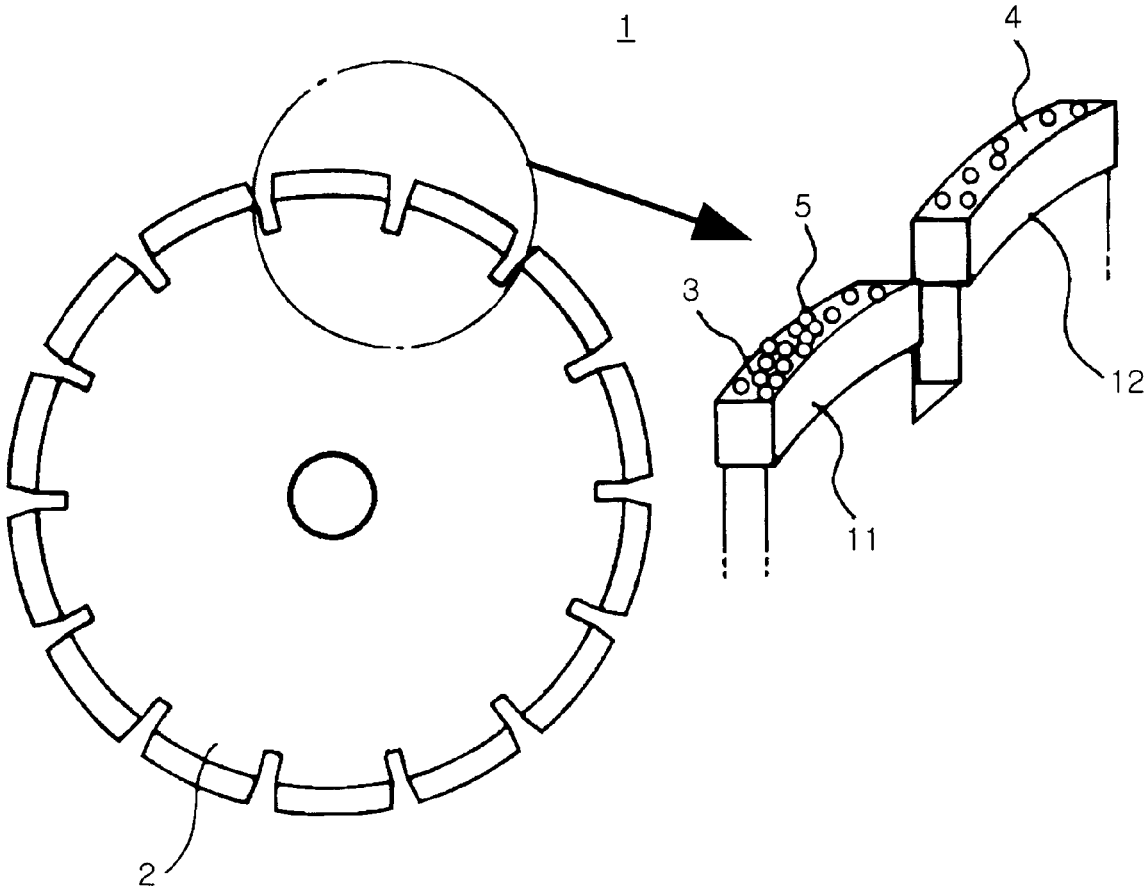
Prior art FIG. 1
FIG. 1 is a view illustrating an example of a typical segment type cutting tool manufactured by sintering.
Figure 2:
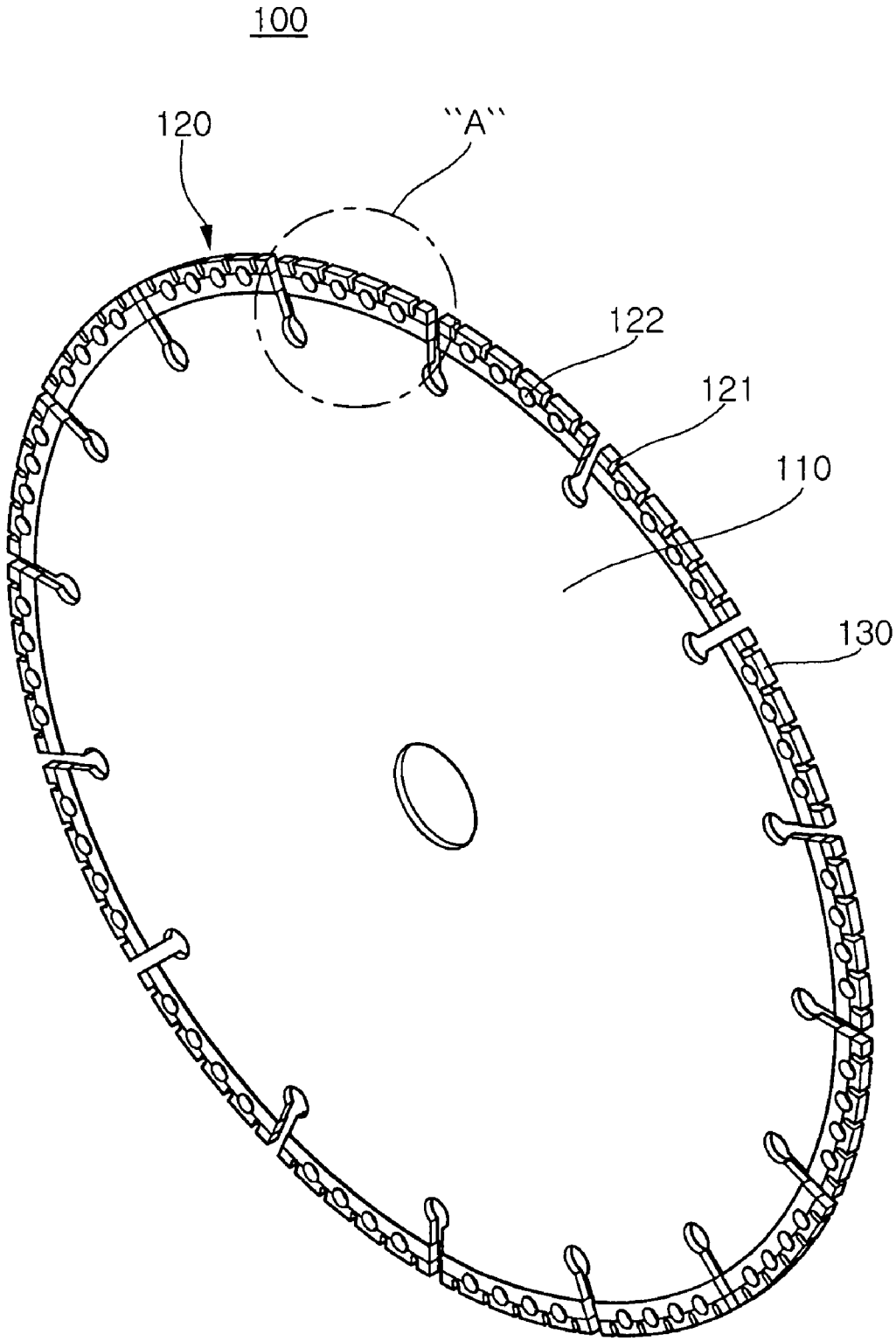
FIG. 2 is a view illustrating an example of the cutting tool of the invention.

FIG. 2 illustrates an example of the cutting tool of the invention.

As shown in FIG. 2, the cutting tool 100 of the invention includes a shank 110 rotatably connected to a driving device (not illustrated) and segments 120 welded at predetermined intervals on an outer periphery of the shank 110.

The segments 120 are welded to the shank 120 after brazing abrasives 130 thereto.

Figure 3:
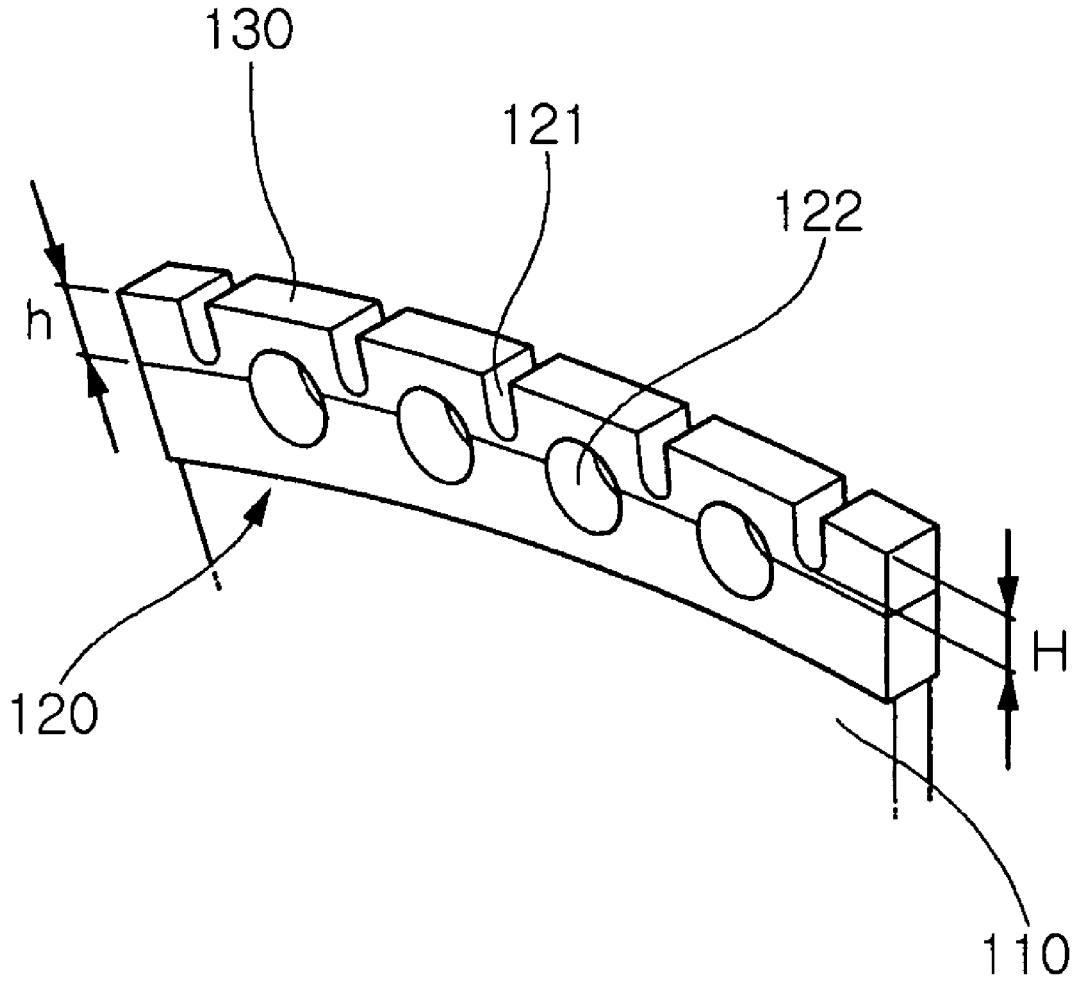
FIG. 3 is a magnified view showing "A" of FIG. 2.

Preferably, the segments 120 have slots 121 and/or through holes 122 as shown in FIGS. 2 and 3.

The slots 121 are formed to enhance cutting capacity, and preferably, a depth H thereof is equal to or smaller than depth h of the part of the segment 110 having the abrasives 130. The slots 121 are formed as described above to prevent cracks caused by stress concentration by complementing stress-concentrated parts of the slots with abrasives.

Preferably, a gap and a width of the slots 121 are about 1.0 to 2.5 mm respectively to gain stability against load and friction heat caused by cutting of a work piece and achieve the maximum cooling effects. More preferably, a gap and a width of the slots 121 are about 1.5 to 2.0 mm respectively.

The through hole 122 blocks transfer of friction heat generated between the tool and the work piece to the shank when the work piece is cut. Also, the hole 122 serves to cool off the segments themselves.

Preferably, the through hole occupies 20~25% of cross section of the total side area of the each segment in a cutting direction. More preferably, the hole represents 22~24% of cross section.

Further, the number of the through holes is properly selected considering hardness of the segments and cooling capacity.

Preferably, the through hole numbers 3 to 5 because too many holes render it difficult to maintain a uniform gap of the holes and the slots and too few holes do not allow proper cooling effects.

The method for manufacturing the cutting tool of the invention will be explained hereunder.

To manufacture the cutting tool of the invention, first a plurality of segments and a shank are fabricated independently.

The segments are attached with abrasives by brazing.

The brazing procedure herein is not limited but applicable if used in general.

Preferably, the brazing is conducted at a temperature of at least 1000° C. considering stability against load and friction heat caused by dry cutting.

Preferably, the segments have at least one slot and/or through hole

Preferably, a depth H of the slots 121 is equal to or smaller than a depth h of the abrasives 130 to be brazed thereto.

Then, the segments fabricated as identified above are welded to the shank.

The joint between the shank and the segments transfers cutting load between the work piece and the cutting tool in cutting to the shank, and thus is required to have hardness enough to retain cutting load in cutting.

As a result, it is preferable to employ welding which ensures great bonding strength.

The welding which is preferably applicable to the invention includes laser welding.

In applying laser welding, preferably, welding is carried out at a speed of 2.0 to 2.5 m per minute in a power output of at least 2.5 kw to gain stability against load and friction heat caused by dry cutting.

As stated above, the present invention ensures higher productivity by independently fabricating segments with abrasives brazed thereto and then welding the same to the shank. The present invention also improves retention of the abrasives and prevents damage to the shank when cutting the work piece, thereby increasing cutting capacity and useful life of the cutting tool.

Further, the present invention enhances cutting capacity of the cutting tool by properly forming the slots on the segments having abrasives attached thereto by brazing.

The present invention blocks transfer of friction heat to the shank in cutting the work piece by properly forming the through holes on the segments having abrasives attached thereto by brazing, and induces cooling of the segments, thereby increasing useful life of the cutting tool.

While the present invention has been shown and described in connection with the preferred embodiments, it will be apparent to those skilled in the art that modifications and variations can be made without departing from the spirit and scope of the invention as defined by the appended claims.

What is claimed is:

1. A cutting tool comprising:

a shank rotatably connected to a driving device; and segments welded at predetermined intervals on an outer periphery of the shank, wherein each of the segments consists of an abrasive part having abrasives attached thereon by brazing and a non-abrasive part which does not have abrasives, and has at least one slot which has a depth being equal to or smaller than that of the abrasive part and at least one through-hole which has one portion extended through the abrasive part and another portion extended through the non-abrasive part, and where each segment is welded after the abrasives are brazed thereto.

2. The cutting tool according to claim 1, wherein a gap and a width of the slots are 1.5 to 2.0 mm respectively.

3. The cutting tool according to claim 1, wherein the through hole occupies 22 to 24% of cross section of the total side area of the each segment in a cutting direction.

4. The cutting tool according to claim 3, wherein the through hole comprises 3 to 5 holes.

5. A method for manufacturing a cutting tool comprising steps of:

independently fabricating a plurality of segments and a shank, the segments each having an abrasive part having abrasives attached thereto by brazing and a non-abrasive part which does not have abrasives, at least one slot which has a depth being equal to or smaller than that of the abrasive part and at least one through-hole which has one portion extended through the abrasive part and another portion extended through the non-abrasive part; and welding the fabricated segments to the shank.

6. The method according to claim 5, wherein a gap and a width of the slots are 1.5 to 2.0 mm respectively.

7. The method according to claim 5, wherein the through hole occupies 22~24% of cross section of the total side area of the segment in a cutting direction.

8. The method according to claim 7, wherein the through hole comprises 3 to 5 holes.

9. The method according to claim 5, wherein the brazing is carried out at a temperature of at least 1000° C. when attaching the abrasives to the segments.

10. The method according to claim 5, wherein the segments are welded to the shank via laser-welding at a speed of 2.0 to 2.5 m per minute in a power output of at least 2.5 kw.

* * * * *